US006990984B2

(12) United States Patent
O'Dwyer

(10) Patent No.: US 6,990,984 B2
(45) Date of Patent: Jan. 31, 2006

(54) HAND HELD NAIL POLISH REMOVAL TOOL

(76) Inventor: Barry O'Dwyer, 12 Meadow Rd., Harrisville, NH (US) 03450

( * ) Notice: Subject to any disclaimer, the term of this patent is extended or adjusted under 35 U.S.C. 154(b) by 499 days.

(21) Appl. No.: 10/243,877

(22) Filed: Sep. 13, 2002

(65) Prior Publication Data

US 2004/0050399 A1 Mar. 18, 2004

(51) Int. Cl.
*A45D 29/18* (2006.01)
*A45D 29/05* (2006.01)

(52) U.S. Cl. ..... 132/74.5; 132/73.6; 132/76.4

(58) Field of Classification Search ..... 132/73.6, 132/74.5, 73.5, 75.3, 75.6, 76.4, 73; 15/22.1, 15/97; 451/910, 270, 271, 357, 356
See application file for complete search history.

(56) References Cited

U.S. PATENT DOCUMENTS

| | | | | | |
|---|---|---|---|---|---|
| 233,067 | A | * | 10/1880 | Buzzell | 15/230.18 |
| 3,316,922 | A | | 5/1967 | Seidler | |
| 3,357,033 | A | * | 12/1967 | Sawyer | 15/98 |
| 4,032,803 | A | | 6/1977 | Durr et al. | |
| 4,176,454 | A | | 12/1979 | Hatter et al. | |
| 4,295,240 | A | * | 10/1981 | Lex | 15/22.1 |
| 4,307,738 | A | | 12/1981 | Barns | |
| 4,858,264 | A | * | 8/1989 | Reinhart | 15/93.1 |
| 5,125,398 | A | | 6/1992 | Horton | |
| 5,190,456 | A | | 3/1993 | Hasegawa | |
| 5,476,384 | A | * | 12/1995 | Giuliani et al. | 433/216 |
| 5,665,141 | A | | 9/1997 | Vago | |
| 5,697,230 | A | | 12/1997 | Ender et al. | |
| 5,921,250 | A | | 7/1999 | Rhea et al. | |
| 5,947,131 | A | * | 9/1999 | Kim | 132/200 |
| 5,992,422 | A | | 11/1999 | Ivory | |
| 6,062,229 | A | * | 5/2000 | Kandratavich et al. | 132/73.6 |
| 6,083,085 | A | * | 7/2000 | Lankford | 451/56 |
| 6,116,248 | A | | 9/2000 | Walker | |
| 6,234,180 | B1 | | 5/2001 | Davis et al. | |
| 6,314,965 | B1 | | 11/2001 | Walker | |
| 6,405,735 | B1 | | 6/2002 | Dockery | |
| 6,536,065 | B2 | * | 3/2003 | Forrest | 15/22.1 |

* cited by examiner

*Primary Examiner*—Kevin Shaver
*Assistant Examiner*—Stephanie L. Willatt
(74) *Attorney, Agent, or Firm*—Cesari and McKenna, LLP; John F. McKenna

(57) ABSTRACT

A hand held nail polish removal tool includes a housing having a main body connected by an elongated neck to a head. An abrasive member is removably attached to the head and the tool contains a vibrator for causing the abrasive member to vibrate so that when the abrasive member is positioned against a finger or toe nail, the abrasive member will abrade away any polish on the nail. The polish removal process may be accelerated by applying a solvent to the abrasive member. This may be done by dipping that member in a solvent or by incorporating a solvent dispensing system in the housing which allows a solvent to be delivered via the head to the member's abrasive surface. Preferably, the tool is powered by rechargeable battery in the housing. Various different abrasive cover members for attachment to the head are also disclosed.

18 Claims, 2 Drawing Sheets

HAND HELD NAIL POLISH REMOVAL TOOL

BACKGROUND OF THE INVENTION

This invention relates to a grooming device. It relates more particularly to a hand held tool for the removal of nail polish from finger and toe nails.

The removal of nail polish is a tedious task. The process usually involves wetting a pad or cotton swab with a volatile solvent and rubbing the coating repeatedly with the pad or swab until the polish is removed. The procedure is also fairly messy because the nail polish becomes soft and finds it way into crevices in the cuticle. Very often the solvent must be reapplied to the pad or swab and more than one swab must be used in order to remove the polish completely from the nail. This may take a good hour to completely clean a set of nails manually during which time one is exposed to the toxic fumes and annoying smell of the solvent.

There have been attempts to make the nail cleaning process more efficient. For example, there are devices that enable one to bathe all of the nails in a polish removing solution in order to facilitate the rubbing away of the polish. We are also aware of devices that brush the nails while they are immersed in a solvent in order to remove the polish. However, these devices take up space, they are prone to spilling, they require the use of an excessive amount of solvent and they are somewhat hazardous to use in confined spaces because of the toxic fumes given off by the solvent.

Also, when such devices are used to remove of polish from toe nails, some people find it difficult to bend down and scrub the softened polish from the toe nails.

SUMMARY OF THE INVENTION

Accordingly, the present invention aims to provide a hand held tool to facilitate the removal of polish from finger and toe nails.

Another object of the invention is to provide a finger and toe nail-cleaning device in the nature of an electrical tool which relies on a moving pad with or without a solvent to remove the polish.

Still another object of the invention is to provide a nail polish removal tool which is easy to use even by aged and infirm individuals.

A further object of the invention is to provide such a tool which increases the reach of the user while cleaning the nails.

Other objects of the invention will, in part, be obvious and will, in part, appear hereinafter.

The invention accordingly comprises the features of construction, combination of elements and arrangement of parts which will be exemplified in the construction hereinafter set forth and the scope of the invention will be indicated in the claims.

Briefly, my nail polish removal tool is a small compact power tool having a main body leading to a narrow neck terminated by a small head which may be rapidly moved or vibrated by an electrically driven vibrator inside the body. The head is normally covered by a cover member in the nature of a scouring pad. When the tool is in use, the cover member thereon is placed against the surface of a finger or toe nail with the result that the rubbing action of the cover member abrades away any polish or other covering on the nail. The surface of the cover member is such that the elements of that vibrating surface are able to penetrate into cracks and crevices enabling the tool to clean even around the cuticle.

Preferably, the tool is used with a polish removing agent or solvent. As we shall see, the solvent may be applied externally to the cover member or incorporated into the cover member itself. In an especially preferred embodiment, the tool may contain a supply of solvent which is delivered under operator control to the cover member via the vibrating tool head. The combination of the vibrating cover member and solvent is particularly effective in removing multiple coatings of polish from finger and toe nails.

As will become apparent, the tool described herein is easy to use and is configured so that it extends the user's reach so that it makes the removal of polish from toe nails much easier for those who have difficulty bending over. The tool is easily adaptable for occasional home use or for intensive use in a salon, clinic, hospital or the like where time is of the essence. Indeed, the tool should greatly reduce the overall time and effort spent on removing polish and other coverings from finger and toe nails.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF ILLUSTRATIVE EMBODIMENTS

Figure 1:
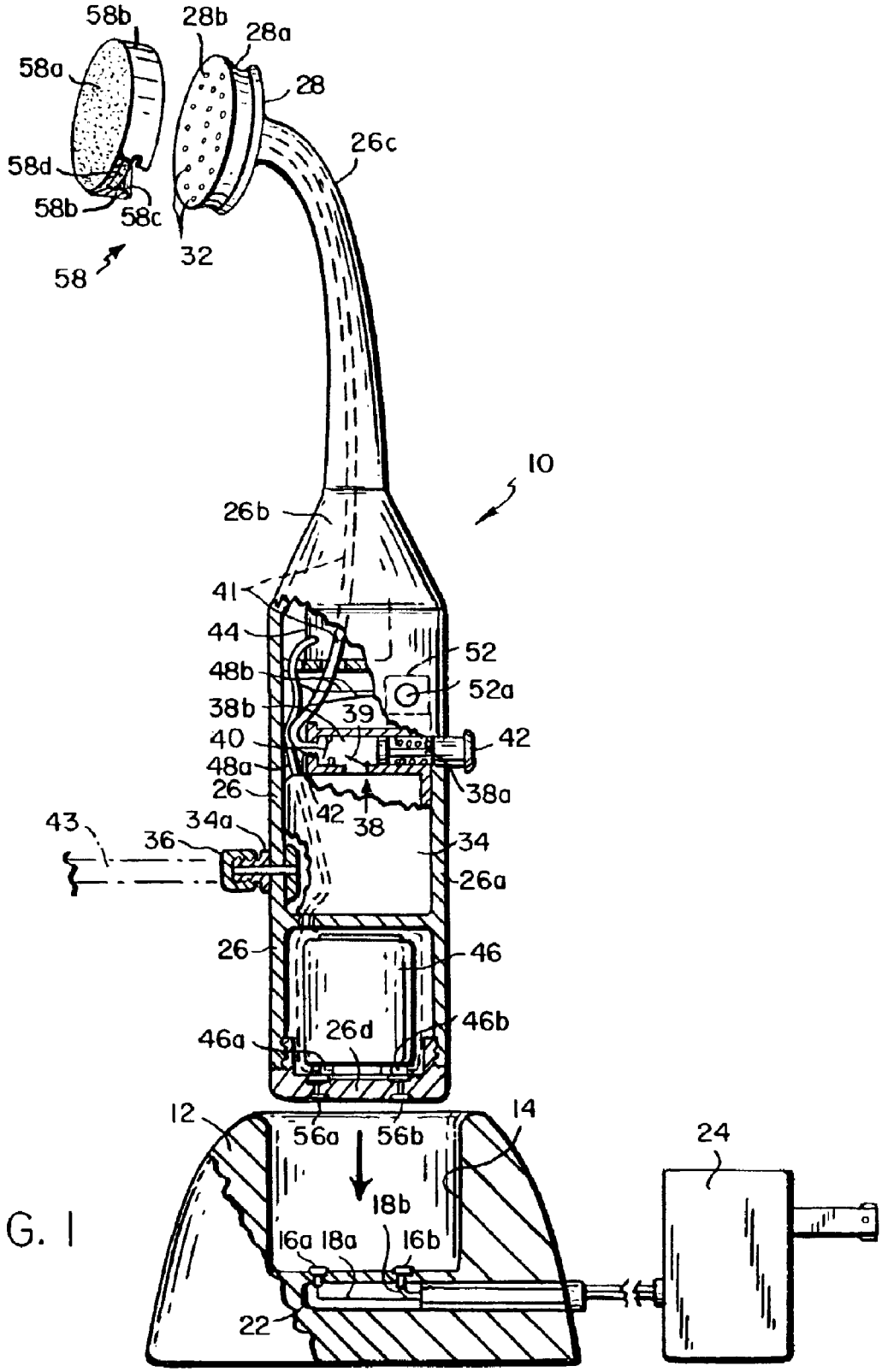
FIG. 1 is an elevational view with parts broken away showing an automatic nail polish removal tool incorporating the invention and used in conjunction with a first type of cover member.

Referring now to FIG. 1, a battery operated nail polish removal tool shown generally at 10 is shown partially seated in a recharging stand 12 having a vertical shaft or receptacle 14 for receiving the lower end of tool 10. A pair of contacts 16*a* and 16*b* at the bottom of receptacle 14 are connected by wires 18*a* and 18*b* extending along a passage 22 in stand 12. Wires 18*a* and 18*b* are connected to a standard AC/DC converter 24 which, when plugged into a standard AC outlet, delivers DC power, e.g. 12 volts, to contacts 16*a* and 16*b*. When tool 10 is fully seated in receptacle 14, battery recharging power may be delivered to the tool.

Still referring to FIG. 1, tool 10 comprises a hollow housing 26 made of a suitable impact-resistant, electrically insulating plastic material such as high density polyethylene, polypropylene or the like. Housing 26 has a generally cylindrically main body 26*a* which transitions at a shoulder portion 26*b* to an elongated smaller diameter tubular neck portion 26*c*. A generally discoid hollow head 28 having a circumfrential groove 28*a* is mounted on its axis to the free end of neck portion 26*c*. Preferably neck portion 26*c* is curved and head 28 is angled relative to housing 26 such that when one holds the tool 10 at housing body 26*a*, the working face or surface 28*b* of head 28 may be placed flush against the surface of a finger or toe nail. While the head surface 28*b* is shown as being flat, it may be curved to conform more to the contour of a nail. For the same reason, surface 28*b* may be elliptical instead of round as shown. In any event, the illustrated head 28 on tool 10 is hollow and its surface 28*b* is provided with a multiplicity of tiny through holes 32 which are distributed over that surface.

Still referring to FIG. 1, tool 10 includes a relatively large container 34 which is situated in housing body 26*a*. Container 34 may be filled with a conventional nail polish solvent via a fill inlet 34*a* extending through the side wall of housing body 26*a*. Inlet 34*a* may be closed by a cap 36. Alternatively, container 34 may be in the form of a replaceable cartridge which may be installed via a suitable door (not shown) in the wall of housing portion 26*a*.

Container 34 includes an integral piston pump 38 at the top of the container which pump may be of a conventional design. The illustrated pump includes a spring-loaded piston 38*a* which when retracted draws solvent from container 34 via a first check valve 39 into piston chamber 38*b*. When the piston 38*a* is extended, the fluid in the chamber 38*b* is delivered via a second check valve 40 to a tube 41 which leads from pump 38 to the interior of head 28. Piston 38*a* is moved to its extended position in opposition to the spring bias by a user pressing on a button 42 in the side of housing body 26*a*. Once the head 28 is primed with solvent, each additional push of button 42 results in solvent exiting the head 28 via holes 32. Preferably, the holes of 32 are small enough and their number is small enough so that the head will remain primed with solvent for a relatively long time between uses and solvent will not leak from head 28 when the tool is laid down on its side.

When tool 10 is being used in a salon or the like, the cap 36 may be removed and the inlet 34*a* connected to a flexible conduit 43 shown in phantom in FIG. 1 and extending to a large volume solvent source (not shown). If container is a cartridge as described above, it may be charged with a gas to expel the solvent through the tube 41 when a valve button is depressed.

As shown in FIG. 1, tool 10 also includes an electric motor-driven vibrator 44 which is situated in the housing body 26*a* above pump 38. The vibrator 44 may be of the type used in conventional electric toothbrushes and arranged so that it vibrates the neck portion 26*c* and/or the head 28 in the same manner as the necks and heads of standard electric toothbrushes. Vibrator 44 receives its power from a rechargeable battery 46 located in housing body 26*a* below container 34. Battery 46 has a contact 46*a* connected by a wire 48*a* to vibrator 44. A second battery contact 46*b* is connected to the vibrator by a wire 48*b* which is diverted on its way to vibrator 44 to a switch 52 mounted in the wall of housing body 26*a* adjacent to button 42. The switch has an actuator 52*a* which projects through the wall of housing body 26. When depressed, actuator 52*a* closes the switch so the power from battery 46 is delivered to vibrator 44 with the result that head 28 vibrates rapidly more or less in the plane of its surface 28*b*.

Battery contacts 46*a* and 46*b* are also connected to external contacts 56*a* and 56*b*, respectively, mounted in a removable bottom wall 26*d* of housing 26. When the tool 10 is fully seated in the receptacle 14 of recharge stand 12, the two contacts 56*a* and 56*b* connect to the stand contacts, 16*a*, 16*b* respectively so that DC power from the converter 24 will be delivered to battery 46.

When tool 10 is in use, its head 28 is usually covered by an abrasive cover member shown generally at 58 in FIG. 1. Cover member 58 should be shaped to conform to the shape of head 28. It includes a generally flat porous rubbing surface 58*a* which is preferably of a woven nylon material similar to a conventional scouring pad. Cover member 58 also includes a skirt 58*b* which extends from the edge of surface 58*a* and is adapted to engage around head 28. Skirt 58*b* is provided with an internal rib 58*c* which can engage in groove 28*a* of head 28 to secure the cover member to the head so that surface 58*a* overlies the openings 32 in the head. Alternatively, an elastic may be hemmed into the edge of skirt 58*b* and adapted to engage around the head 28.

Prior to using tool 10, the head 28 is primed with solvent by repeatedly depressing button 42 until solvent issues from holes 32 and penetrates the surface 58*a* of cover member 58. To help maintain the surface 58*a* in a wetted condition, a thin layer of open cell foam material may be provided on the inside of surface 58*a* as is shown at 58*d* in FIG. 1. Once the head 28 is primed with solvent, the tool 10 may be manipulated to position the cover member 58 against the nail to be cleaned. Subsequent depression of switch actuator 52*a* energizes vibrator 44 causing head 28 and the cover member 58 thereon to vibrate rapidly. This rapid vibration works the solvent present at the cover member surface 58*a* into the nail polish layer thereby softening that layer and allowing it to be abraded away by surface 58*a*, elements of which are able to penetrate into depressions and crevices at the nail cuticle. Resultantly, tool 10 allows the nail to be cleaned thoroughly in a minimum amount of time.

Figure 2:
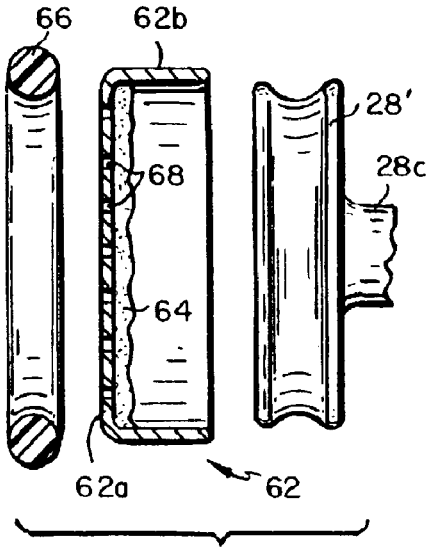
FIG. 2 is an exploded side elevational view, with parts broken away, of the tool equipped with a second type of cover member.

FIG. 2 shows generally at 62 a somewhat different cover member which may be used with a tool such as tool 10. Like cover member 58, cover member 62 has a perforate scouring or abrasive surface 62*a* and a skirt 62*b* arranged to engage around a grooved tool head 28'. In addition, however, the cover member 62 contains a supply of solvent gel 64 backing up the surface 62*a*. When the cover member is fitted on head 28', the gel layer 64 is engaged by the working surface of head 28'. The cover member may be held in place on head 28' by an O-ring 66 which presses the skirt 62*b* into the circumfrential groove in the head 28'. Of course, in lieu of O-ring 66, the cover member 62 may be provided with an internal rib similar to rib 58*c* in FIG. 1.

When using my tool with the cover member 62, the pressure of the tool head 28' against the nail forces the solvent gel 64 through tiny holes 68 in the cleaning member surface 62*a* so that that surface and the nail which it contacts are wetted with solvent. Resultantly when head 28' is vibrated, nail polish is removed in the same efficient manner described above in connection with FIG. 1. Also, since the tool itself is not delivering solvent, head 28' may be solid and the solvent delivery system in the tool, i.e. container 34, pump 38 and tube 41 may be eliminated, thereby reducing the cost of the tool.

Once the polish is removed from the nails using tool 10, those nails may be buffed by substituting for the cover member 58 or 62 a similarly shaped cover member having a smooth surface and the tool used without the application of solvent.

Figure 3:
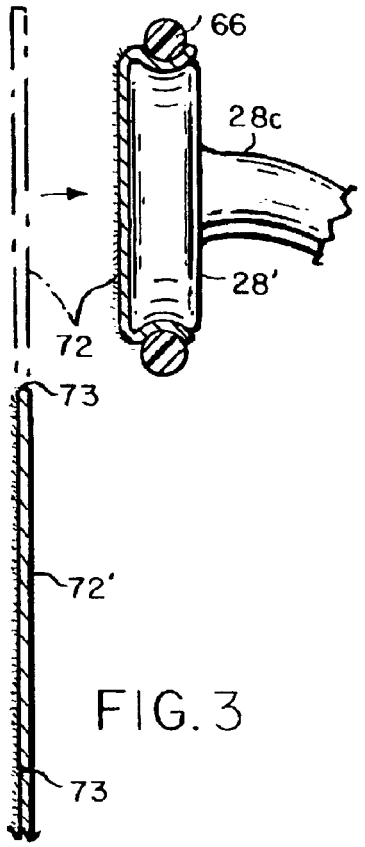
FIG. 3 is a similar view of a third type of cover member which may be used with the FIG. 1 tool.

FIG. 3 illustrates generally at 72 still another type of cover member which may be used with the FIG. 1 tool 10 when the tool is not supplying solvent. In this case, cover member 72 is a segment of woven nylon scouring or abrasive material separated at a parting line 73 from a segmented strip or roll 72' of such material. The cover member 72 from strip 72' may be gathered around head 28' (or 28) and held in place by an O-ring 66 as shown in FIG. 3.

Figure 4:
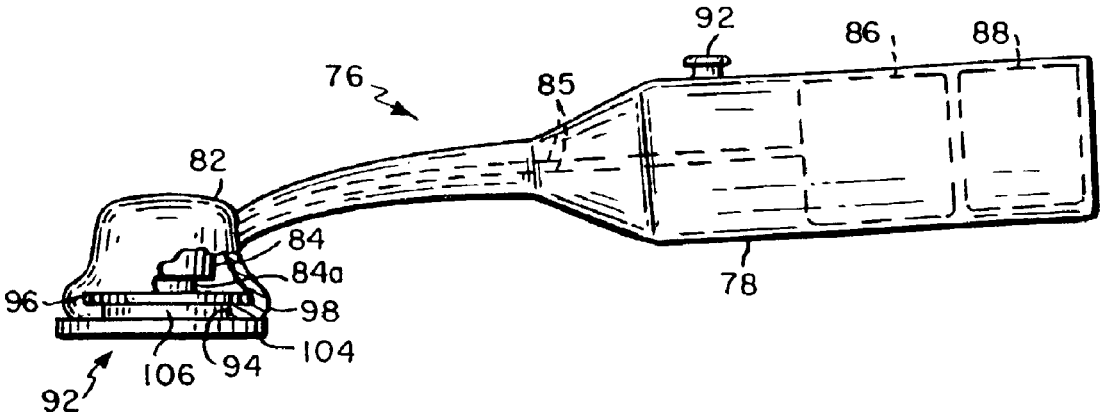
FIG. 4 is a view similar to FIG. 1 of a second tool embodiment.

Turn now to FIG. 4 which shows generally at 76 a hand held nail polish removal tool that cleans ultrasonically. Tool 76 includes a hollow housing 78 which supports a hollow head 82 containing an ultrasonic transducer 84. Transducer 84 is connected electrically by wires 85 to a conventional signal generator 86 including a driver in housing 78, the generator being powered by a rechargeable battery 88 in the housing. Once a switch button 92 in the side of housing 78 is depressed, unit 86 delivers a high frequency, e.g. greater than 17 kHz, driving signal to transducer 84 so that the working surface or head 84*a* of transducer 84 vibrates ultrasonically.

The ultrasonic tool 76 is used in conjunction with a cleaning member shown generally at 92. For this, the head 82 has a bottom opening 94 and an end slot 96 which leads to a pair of laterally spaced apart parallel rails 98, 98 adjacent bottom opening 94, these slotted rails forming a keyway in head 82.

Member 92 is shaped and arranged to slide into slot 96 and key into head 82. More particularly, cleaning member 92 comprises an abrasive scrubbing strip 104 which is supported by a support 106 in the form of a key enabling member 92 to be slid endwise into the end of housing 82 through slot 96 so that the upper surface of support 106 is engaged by the transducer head 84*a* and the abrasive strip 104 hugs the underside of housing 52 as shown in FIG. 4. In accordance with the invention, the cleaning member 92, and particularly its support 106, is rigid so that when transducer 84 is operative, the vibrations produced thereby are coupled via support 106 to strip 104 and thence to the nail contacted by that strip.

When using tool 76 to clean finger and toe nails if it is desired to apply solvent to the nails, that may be done by momentarily dipping the cleaning member 92 in solvent or by modifying the tool 76 to include the solvent dispensing system illustrated in FIG. 1.

In some tool models it may be desirable to make the head or neck separable from the main body of the tool to facilitate replacement of the head and/or repair of the tool. In this event, a suitable connection or joint may be provided in housings 26 and 78 between the neck portion and the housing main body, e.g. a bayonet or pin-in-slot connection.

It will be seen from the forgoing that my tool provides a very efficient means for removing nail polish from finger and toe nails and for generally cleaning and buffing such nails. The tool is easy to use even by aged and infirm individuals and, since the solvent is confined to the tool head 28 (or 28' or 82) and its cover member, the toxic and noxious effects of the solvent are kept away from the user. Therefore, the tool should prove to be a very marketable toiletry item.

It will thus be seen that the objects set forth above, among those made apparent from the preceding description, are efficiently attained. Also, certain changes may be made in the above constructions without departing from the scope of the invention. For example, the AC/DC converter could be incorporated into tools 10 or 76. Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A hand held nail polish removal tool comprising a housing including a hollow main body and a hollow head having a perforated working surface and a periphery, said head being connected to the main body;

an abrasive member having a perforated abrasive surface, said member being shaped and arranged for attachment to the bead so that said abrasive surface is flush against the working surface of the head;

securing means removably securing the abrasive member to the head;

motor means in the main body for vibrating the working surface;

power supply means;

switch means connected between the power supply means and the motor means and being accessible from outside the housing for selectively delivering power to the motor means;

a solvent container in said housing, and means in the housing and accessible from outside of the housing for pumping solvent from said container into said head under pressure so that the solvent penetrates said working and said abrasive surfaces.

2. The tool defined in claim 1 wherein the head is separable from the main body.

3. The tool defined in claim 1 wherein the head is connected to the main body via an elongated neck.

4. The tool defined in claim 1 wherein the power supply means include a battery in the housing.

5. The tool defined in claim 4 wherein the battery is a rechargeable battery electrically connected to external contacts mounted to the main body of the housing.

6. The tool defined in claim 5 and further including recharging means for recharging the battery.

7. The tool defined in claim 6 wherein the recharging means include a recharging stand including a receptacle for receiving the portion of the main body containing said external contacts and additional contacts in said receptacle which are contacted by the external contacts when said portion of the main body is received in the receptacle, and means including an AC/DC converter for supplying power to said additional contacts.

8. The tool defined in claim 1 wherein said abrasive surface is of woven nylon.

9. The tool defined in claim 1 wherein said abrasive member includes, in addition to said abrasive surface, a skirt extending from said abrasive surface, and said securing means include resilient means for urging said skirt into interfitting engagement with the periphery of said head.

10. The tool defined in claim 9 wherein the periphery of said head is grooved and said resilient member includes a rib on said skirt.

11. The tool defined in claim 9 wherein the periphery of said head is grooved and said resilient member includes an O-ring.

12. The tool defined in claim 9 wherein said abrasive surface is provided with a foam backing.

13. The tool defined in claim 9 and further including a body of solvent gel between said abrasive surface and said working surface.

14. The tool defined in claim 9 wherein said abrasive surface is of woven nylon.

15. The tool defined in claim 1 wherein said motor means comprise an ultrasonic transducer in said head, said transducer having a vibrating surface mechanically contacting said abrasive member, and said power supply means include a signal generator and driver for driving said transducer at selected frequencies.

16. A hand held nail polish removal tool comprising a housing including a hollow main body and a head having a working surface and a periphery, said head being connected to the main body;

an abrasive member having a perforated abrasive surface and a body of solvent gel covering a rear face of said abrasive surface, said member being shaped and arranged for attachment to the head so that said body is flush against the working surface of the head;

securing means removably securing the abrasive member to the head;

motor means in said main body and for vibrating the working surface;

power supply means, and switch means connected between the power supply means and the motor means and being accessible from outside the housing for selectively delivering power to the motor means.

17. The tool defined in claim 16 wherein the abrasive surface is a woven nylon.

18. The tool defined in claim 17 wherein said abrasive member includes, in addition to said abrasive surface, a skirt extending from said abrasive surface, and the securing means secure said skirt around the periphery of said head.

* * * * *